US005983470A

United States Patent [19]

Goineau

[11] Patent Number: 5,983,470

[45] Date of Patent: Nov. 16, 1999

[54] METHOD TO PRODUCE BULKED DEEP DYED FABRIC

[75] Inventor: André M. Goineau, Williamston, S.C.

[73] Assignee: Milliken & Company, Spartanburg, S.C.

[21] Appl. No.: 09/105,360

[22] Filed: Jun. 26, 1998

[51] Int. Cl.[6] ..... D02J 1/02

[52] U.S. Cl. ..... 28/281; 28/220; 28/166; 28/169

[58] Field of Search ..... 28/217, 220, 240, 28/245, 246, 252, 271, 281, 283, 165, 166, 167, 163, 169; 57/239; 264/103, 289.6

[56] References Cited

U.S. PATENT DOCUMENTS

| | | | |
|---|---|---|---|
| 3,579,764 | 5/1971 | Kieffer | 28/169 |
| 3,676,906 | 7/1972 | Eggleston | 28/169 |
| 3,959,962 | 6/1976 | Wilding | 28/281 |
| 4,112,668 | 9/1978 | Spiller | 28/281 |
| 4,571,793 | 2/1986 | Price | 28/220 |
| 4,965,919 | 10/1990 | Fujita et al. | 28/281 |
| 5,407,621 | 4/1995 | Collins et al. | 28/172.2 |
| 5,417,902 | 5/1995 | Bennie et al. | 28/254 |
| 5,634,249 | 6/1997 | Ballarati | 28/240 |

*Primary Examiner*—Amy Vanatta
*Attorney, Agent, or Firm*—Terry T. Moyer; Earle R. Marden

[57] ABSTRACT

A polyester multifilament synthetic yarn which has a low draw ratio and a bulk characteristic made by overfeeding the yarn in the range of 4–12% that provides a double plush fabric, when knit, that has a pleasant broken pattern look with at least a 25% increase in bulk. The yarn used is obtained by treating a low draw ratio polyester yarn in a hot relaxation and setting zone after drawing prior to take-up.

11 Claims, 4 Drawing Sheets

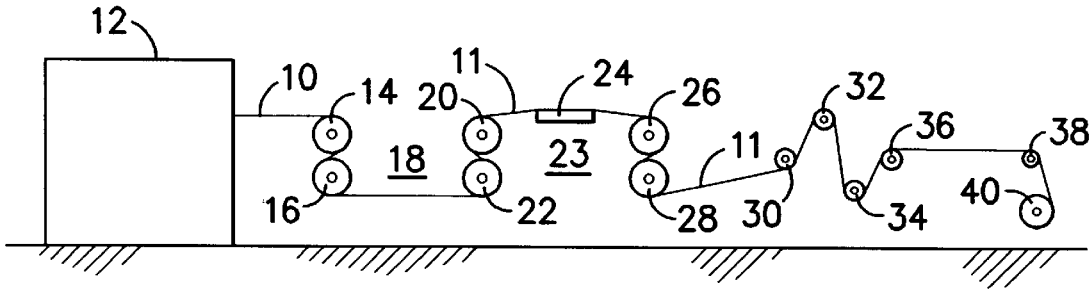
FIG. —1—
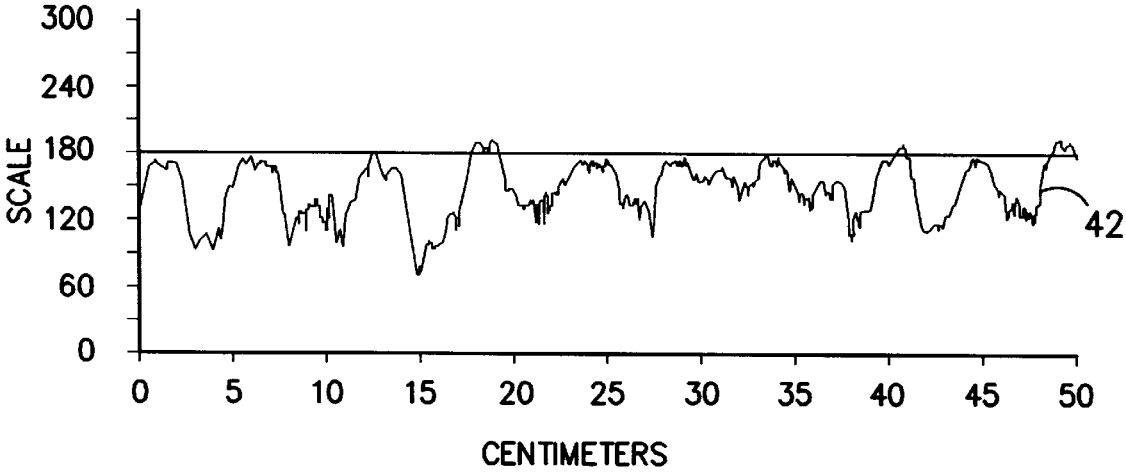
FIG. —4—

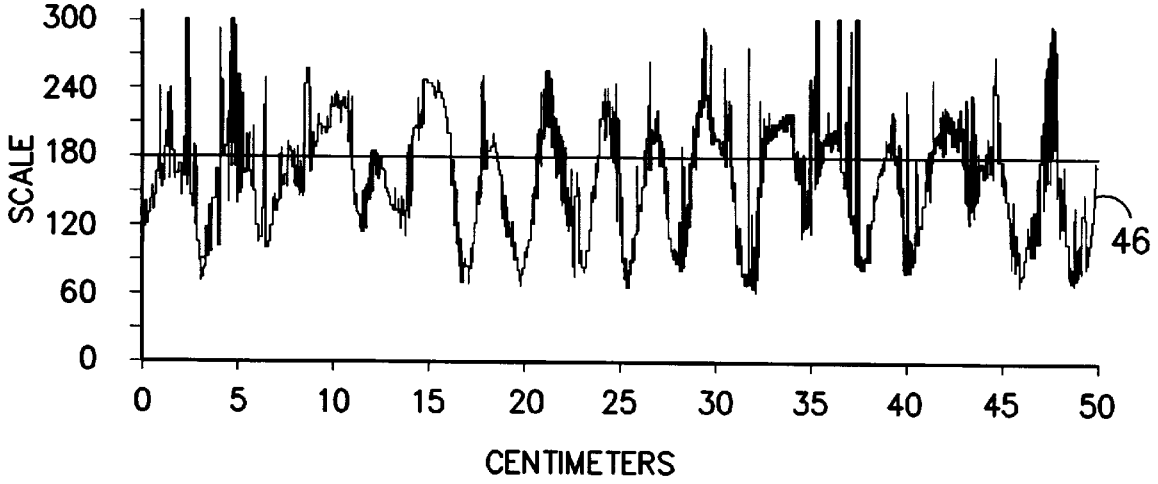
*FIG. —5—*
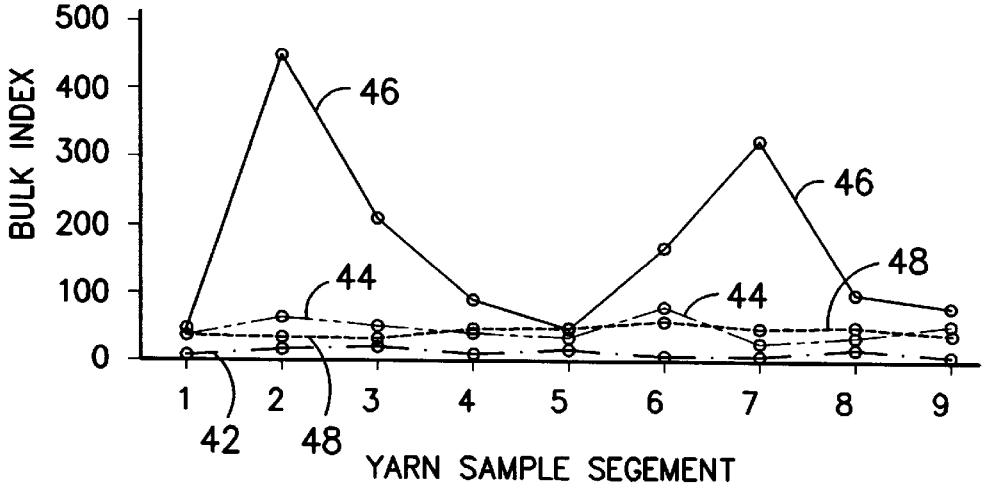
*FIG. —6—*

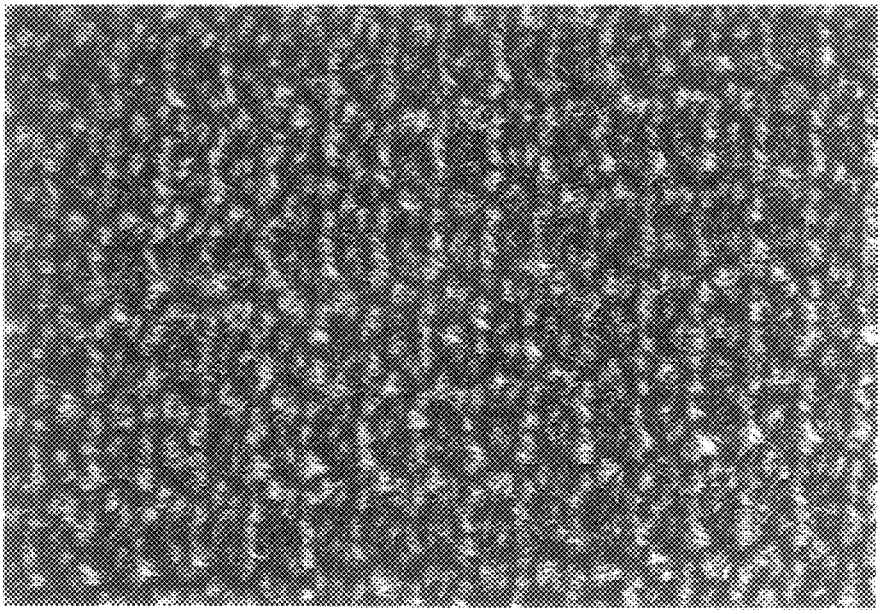
FIG. —7—
(PRIOR ART)
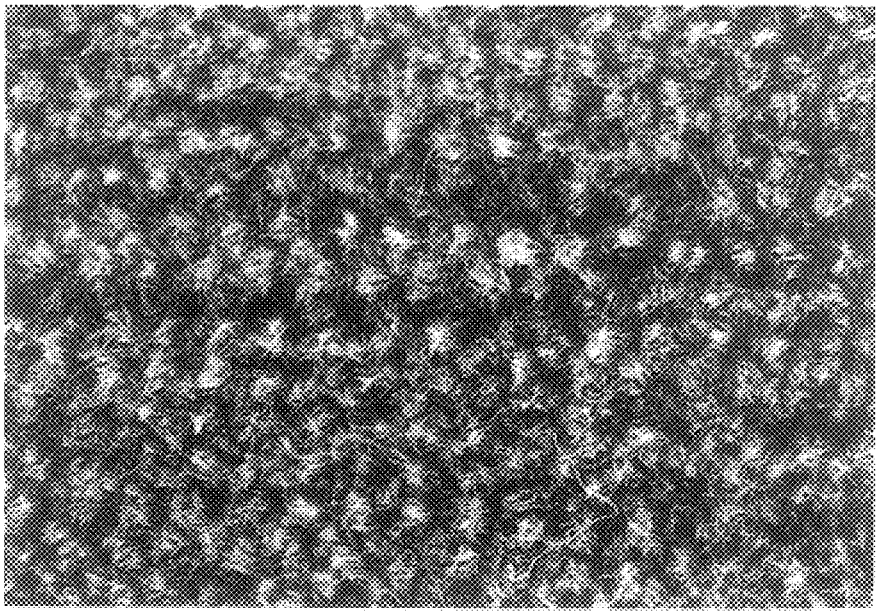
FIG. —8—

METHOD TO PRODUCE BULKED DEEP DYED FABRIC

This invention relates to the production of a deep dyeing yarn from a polyester partially oriented yarn (POY) which, when produced and knit into a double plush fabric provides a broken, bulked pattern look in the resulting fabric when the double plush fabric is severed, dyed and bulked.

In the past, warp yarns have been made with a draw ratio below what is considered normal and when converted into fabric provides a fabric, when dyed, having a uniform appearance similar to what is expected of polyester cationic dyeable yarns. Therefore, the purpose of the disclosed invention is to provide a bulky polyester warp yarn having a low draw ratio which, when knit into a double plush fabric on a double needle bar warp knitting machine, provides a knit fabric, when the double plush fabric is severed, dyed, and bulked has a broken, bulked pattern look. Furthermore, the dyed, severed double plush fabric is unusually soft and has an increased bulk of about 25%.

Therefore, it is an object of the invention to provide a method to produce a deep dyeing yarn which, when knit and dyed, will provide a random pattern of normal yarn portions and increased bulk.

Other objects and advantages of the invention will become readily apparent as the specification proceeds to describe the invention with reference to the accompanying drawing, in which:

FIG. 1 is a schematic representation of the new and novel polyester yarn treatment method;

FIGS. 4 and 5 show a profile of a control yarn and the new and novel yarn, respectively, heat treated to show the bulkiness of the yarn per unit length.

FIG. 6 is a graph illustrating the comparison of the same yarn run with different amounts of overfeed and then bulked and FIGS. 7 and 8 show a comparison of knit fabrics using, respectively, the control yarn and the new and novel yarn after it has been knit and bulked.

Figure 2:
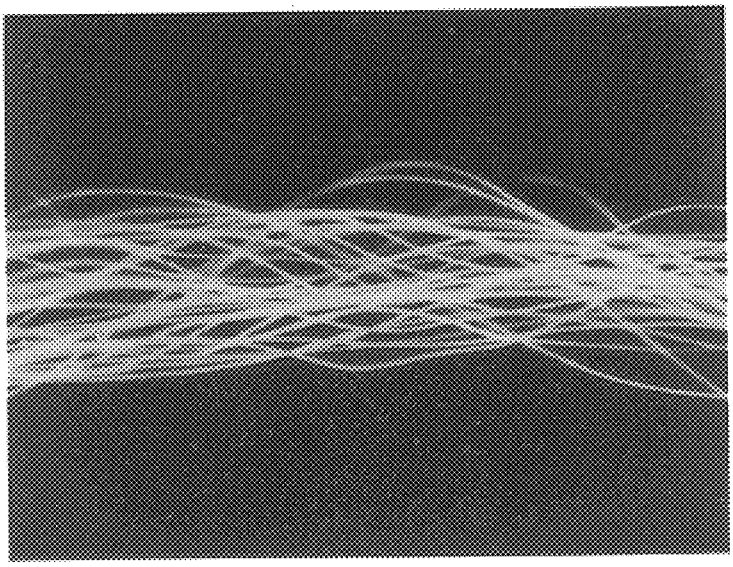
FIG. -2- (PRIOR ART)
FIG. 2 is a photomicrograph showing a normal low draw ratio warp yarn.

Looking now to FIG. 1, the improved invention is shown schematically and in the preferred embodiment, 170 denier, 50 filament polyester POY 10 is the preferred starting yarn supplied from a creel 12. It should be understood that other continuous filament synthetic yarn and other denier polyester yarns can be employed within the scope of the invention.

The 170 denier polyester yarn is drawn from the creel 12 by a set of nip rolls 14, 16 at a rate of 307 yds/min and is cold drawn in the zone 18 by the nip rolls 20, 22 driven at a speed to take the yarn 10 at a rate of 393 yds/min resulting in a low draw ratio of 1.28. The drawn yarn 1 is pulled over a heater 24 in the overfeed zone 23 at a rate of 350 yds/min by the rolls 26, 28. The heater 24 is operating at a temperature of about 170° C. at a draw ratio of 0.89 to provide heat setting and relaxation of the yarn 10. From the rolls 26, 28 the heat set and relaxed yarn is supplied over a series of idler rolls 30, 32, 34, 36 and 38 to the warper take-up roll 40.

In the textile industry, the term C.V. refers to the coefficient of variation of the yarn which in layman terms means the evenness of the yarn. This is determined by the formula:

$$C.V. = \frac{\text{Diameter Standard Deviation}}{\text{Average Diameter}} \times 100\%$$

From the formula it can be seen that the lower the standard deviation of the yarn, the lower the C.V. value will be and that a low C.V. value results in a more even yarn.

Figure 3:
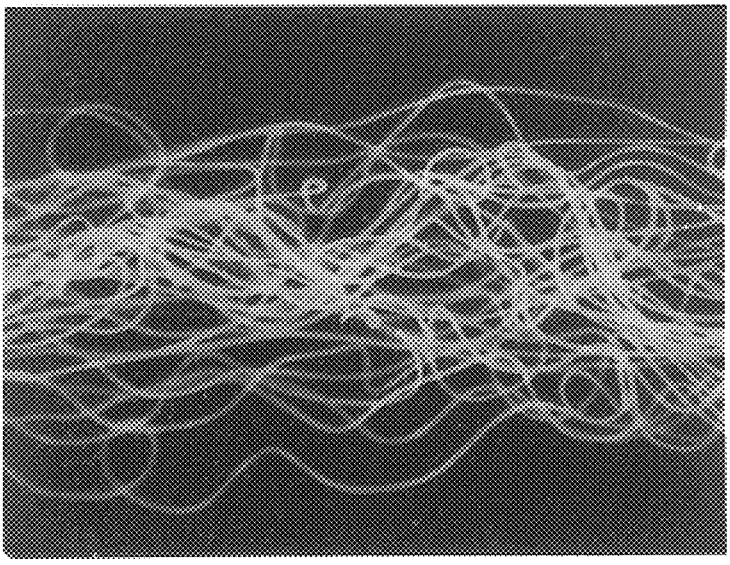
FIG. 3 is a photomicrograph showing a low draw ratio warp yarn produced as shown in FIG. 1.

Looking now to FIGS. 2 and 3, a comparison of a low draw ratio polyester yarn is shown. The starting yarn for both FIGS. 2 and 3 is 170 denier, 50 filament polyester POY with the difference between the yarn of FIGS. 2 and 3 being that FIG. 3 represents a polyester yarn treated as shown in FIG. 1.

Looking now to FIGS. 4–6, there is shown a comparison of the same basic polyester yarns which have been treated as shown in FIG. 1 except the overfeed rate in the zone 23 has been varied along with a lower draw ratio than the control yarn 42. The following cold drawn samples were made using the method shown in FIG. 1 and using the following parameters along with being heat set at 200° C. at a speed of 450 yards per minute.

Yarn 42—Draw ratio of 1.8 with 2.8% overfeed.

Yarn 44—Draw ratio of 1.2 with 2.8% overfeed.

Yarn 46—Draw ratio of 1.2 with 8.6% overfeed.

Yarn 48—Draw ratio of 1.2 with 0% overfeed.

For comparison the control yarn 42 is shown in FIG. 4 and the preferred high overfeed yarn 46 shown in FIG. 5 with all of the above indicated yarns shown in FIG. 6.

These samples were then heat "bulked" on the Dynafil with 2.5% overfeed for the non-contact 1 meter long heater set at 150° C. and running in creep speed at 3.8 m/min in order to mimic "free shrinkage" as it would occur in the case of the pile of a double needle bar fabric at finishing. Collected on the Dynafil on a small spool these yarn samples were then "profiled" on a Lawson and Hemphill Constant Tension Tester (CTT) at a constant 5 g of tension and at a 10 m/min speed. Nine separate yarn segments 1–9 along each running yarn sample were profiled and stored in computer memory. The analysis threshold to count the filaments or group of filaments as the instrument has the capability of doing, was set at 180 pixels. This number is approximately what the diameter of the yarn would be, were it a perfect cylinder with all the filaments perfectly parallel and bundled together. With the bulking step, the higher the bulk and the higher the number of crossings of this set threshold as shown in FIG. 5. This average number of crossings of the profile threshold, averaged per linear meter of the yarn sample, is what we call our "bulk index", as it relates to the apparent space volume of the yarn. This bulk index is more accurate to compare the yarn samples made with the same draw ratio.

Plotting the bulk index for each segment of the profiled yarns shows the exceptional bulk characteristics of the sample with 1.2 draw ratio and 8.6% overfeed in the draw-warper relaxing zone versus the control or the other sample yarns as shown in FIG. 6.

In the preferred form of the invention the desired draw ratio was 1.2 while the overfeed in the overfeed zone was 8.6%. It is understood that the draw ratio can vary between 1.0 and 1.7 and the overfeed between 4% and 12% to increase the bulk characteristics of the yarn to provide the deep dyeing trait as well as a broken pattern look in the face of the fabric as shown in FIG. 8.

In one form of the invention the yarn 46 was knit into a double plush warp and knit fabric and slit to provide two plush pile fabrics which we then bunked at a higher temperature to produce the fabric shown in FIG. 8 which has a greater bulk of about 25% and a broken pattern look compared to the fabric of FIG. 7 which was treated in the same manner except the control yarn 42 was used to form the fabric.

The preferred use of the herein disclosed polyester yarn is the knitting of the yarn on a double needle bar warp knitting machine which produces a double plush fabric. The double plush fabric is then slit centrally thereof in a direction parallel to the backing to supply two plush pile fabrics. When the fabric is dyed in a heated dye bath, the fabric presents a pleasing broken pattern look with a soft hand and a crimped surface caused by about a 25% increase in bulk. These esthetic effects are caused by a higher C.V. which presents more uneven yarn surfaces than normal to absorb dye and to be effected by the temperature of the dye bath and the overfeed (relaxation) of the yarn 4–12% after drawing and prior to take-up.

The above-described embodiments are given for the purpose of illustration only. Improvements and modification may be made to those embodiments without departing from the scope of the invention.

I claim:

1. A method to produce a deep dyeable polyester yarn comprising the steps of: supplying a partially oriented multifilament, polyester yarn, cold drawing said yarn with a low draw ratio, overfeeding said drawn yarn between 4–12% into a heated relaxation zone to relax and heat set said drawn yarn and taking up said drawn, heat set and relaxed yarn to provide a yarn with increased bulk characteristics.

2. The method of claim 1 wherein said yarn is drawn with a ratio greater than 1.0 but less than 1.7.

3. The method of claim 1 wherein said yarn relaxed and heat set in the hot relaxation zone provides a C.V. greater than 3% in the yarn.

4. The method of claim 3 wherein the C.V. is within the range of 8–12%.

5. The method of claim 4 wherein said yarn is drawn with a ratio greater than 1.0 but less than 1.7.

6. A method to produce a fabric with a dyed high bulk, broken pattern surface effect comprising the steps of: supplying a partially oriented polyester multifilament, cold drawing said yarn with a low draw ratio, overfeeding said drawn yarn between 4–12% into a heated relaxation zone to relax and heat set said drawn yarn, supplying said drawn, heat set and relaxed yarn to a fabric producing machine, making a fabric from said yarn and heating said yarn to bulk said yarn in said fabric to produce a bulked, broken pattern effect on the face of said yarn.

7. The method of claim 6 wherein said fabric producing machine is a warp knit machine.

8. The method of claim 7 wherein said warp knitting machine is a double plush machine and said knit fabric produced is slit to provide two plush fabrics prior to knitting.

9. The method of claim 8 wherein said yarn is drawn with a ratio greater than 1.0 but less than 1.7.

10. The method of claim 9 wherein the C.V. is within the range of 8–12%.

11. The method of claim 10 wherein said yarn is drawn with a ratio greater than 1.0 but less than 1.7.

* * * * *